United States Patent [19]

Hildebrand

[11] Patent Number: 4,891,100

[45] Date of Patent: Jan. 2, 1990

[54] APPARATUS FOR RETAINING A PARTITION FOIL

[75] Inventor: Otto Hildebrand, Ravensburg-Taldorf, Fed. Rep. of Germany

[73] Assignee: Sulzer-Escher Wyss GmbH, Ravensburg, Fed. Rep. of Germany

[21] Appl. No.: 318,548

[22] Filed: Mar. 3, 1989

[30] Foreign Application Priority Data

Mar. 9, 1988 [DE] Fed. Rep. of Germany ..... 3807629

[51] Int. Cl.[4] ..... D21F 1/02

[52] U.S. Cl. ..... 162/343; 162/336; 162/347; 162/344

[58] Field of Search ..... 162/336, 343, 344, 347

[56] References Cited

U.S. PATENT DOCUMENTS

| | | | |
|---|---|---|---|
| 4,181,568 | 1/1980 | Pfaler | 162/343 |
| 4,358,342 | 11/1982 | Nutall | 162/259 |
| 4,361,467 | 11/1982 | Bubik et al. | 162/347 |
| 4,445,974 | 1/1984 | Stenberg | 162/344 |
| 4,812,209 | 3/1989 | Kinzler | 162/343 |

FOREIGN PATENT DOCUMENTS 3227218 10/1984 Fed. Rep. of Germany .

*Primary Examiner*—Karen M. Hastings
*Attorney, Agent, or Firm*—Werner W. Kleeman

[57] ABSTRACT

In a multi-ply headbox of a papermaking machine, a flexible partition foil or sheet is connected by an apparatus to a rigid partition element dividing the nozzle chamber. For rapid replacement of the flexible partition foil or sheet, the apparatus comprises an upper retaining strip and a lower retaining strip which are structured for force-locking, or form-closed or form-locking clamping of the flexible partition foil or sheet therebetween and secured at the rigid partition element. Between the upper and lower retaining strips there is provided a pressure chamber of a pressure device, which pressure chamber can be impinged by a pressurized fluid medium for spreading or expanding, if necessary, the upper and the lower retaining strips. The pressure chamber possesses the shape of a continuous groove extending across the entire outlet width of the headbox. This groove is lined with an elastic sealing coating or lining and the space bounded by such elastic sealing coating is connected via lines or conduits to a pressurized fluid medium source.

5 Claims, 1 Drawing Sheet

APPARATUS FOR RETAINING A PARTITION FOIL

CROSS-REFERENCE TO RELATED PATENT APPLICATION

This application is related to a commonly assigned, copending U.S. Pat. Application Ser. No. 07/149,658, filed Jan. 28, 1988, now U.S. Pat. No. 4,824,524 entitled "MULTI-PLY HEADBOX FOR A PAPERMAKING MACHINE".

BACKGROUND OF THE INVENTION

The present invention broadly relates to a multi-ply headbox for a papermaking machine and, more specifically pertains to a new and improved apparatus for retaining a partition foil or sheet or lamella or the like.

Generally speaking, the apparatus of the present invention is of the type comprising a partition foil or sheet which is secured at a partition or divider element dividing a nozzle chamber of the headbox and serves to continue to keep apart plys of paper stock across a predetermined distance or length in the direction of paper stock travel in the papermaking machine.

The partition foil or sheet or the like is formed of a flexible material and mounted by means of an apparatus at the partition or divider element at a tip or free end region thereof at a joining or connecting location, which tip or free end region is directed in or faces the outlet direction of the headbox. For the assembly and disassembly of the partition foil or sheet, a relatively complicated and time-consuming assembly operation is required. Such assembly or disassembly is necessary when the partition foil is exchanged depending on varying requirements as concerns the length of the partition foil or sheet as viewed in the outlet direction in order to adapt the headbox to different work or operational requirements of the papermaking machine, or when maintenance or servicing is required after wear or abrasion of the partition foil or sheet. A known arrangement of a partition foil or sheet is disclosed, for example, in West German Pat. No. 3,227,218, published Oct. 18, 1984.

SUMMARY OF THE INVENTION

Therefore, with the foregoing in mind it is a primary object of the present invention to provide a new and improved construction of an apparatus for retaining a partition foil or sheet which does not suffer from the aforementioned drawbacks and shortcomings of the prior art constructions.

Another and more specific object of the present invention aims at the provision of a new and improved construction of a retaining apparatus of the previously mentioned type which renders possible a rapid exchange or replacement of the partition foil or sheet without any complicated and time-consuming disassembly and assembly.

Yet a further significant object of the present invention is directed to an improved apparatus for retaining a partition foil or sheet or lamella or the like and which is relatively simple in design, economical to manufacture, extremely reliable in operation, not readily subject to malfunction and requires a minimum of maintenance.

Now in order to implement these and still further objects of the present invention, which will become more readily apparent as the description proceeds, the apparatus for retaining a partition foil or sheet or the like of the present invention is, among other things, manifested by the features that there is provided an upper retaining or holding strip or ledge member and a lower retaining or holding strip or ledge member which are structured to clamp or lock-in therebetween a part of the partition foil or sheet or the like and are secured at the partition or divider element. A pressure chamber of a pressure device is provided between the upper retaining or holding strip or ledge member and the lower retaining or holding strip or ledge member. The pressure chamber can be impinged by a pressurized fluid medium such that the upper retaining or holding strip or ledge member and the lower retaining or holding strip or ledge member are spreadable or expandable relative to one another. By pressurizing the pressure chamber of the pressure device, the upper retaining or holding strip or ledge member and the lower retaining or holding strip or ledge member are spread apart and leave free between them a space or region which is required for the assembly and disassembly of the partition foil or sheet between the upper and lower retaining or holding strips or ledge members. After decreasing the pressure in the pressure chamber, the two retaining or holding strips or ledge members bear against one another, so that the retention of the inserted partition foil or sheet or the like is effected downstream of the nozzle outlet or slice or slice opening.

The pressure chamber of the pressure device advantageously possesses the shape or configuration of a continuous groove through-going or extending across the entire width of the headbox. This groove is lined with a suitable elastic sealing coating or lining, and the space of the pressure chamber bounded by such coating or lining is connected to a pressurized fluid medium source via lines or conduits or the like provided for the impinging pressurized fluid medium.

The upper retaining or holding strip and the lower retaining or holding strip are preferably arranged with respect to one another with a pre-load or bias for clamping or locking-in a fastening or securing edge or rim of the partition foil or sheet.

The upper retaining or holding strip and the lower retaining or holding strip are advantageously structured in mirror-image fashion or relationship with respect to one another. In the predetermined outlet direction of the flow of the paper stock, these two retaining or holding strips can terminate with an edge or tip or pointed terminal region. On the other hand, such retaining or holding strips can terminate in the outlet direction of paper stock flow with a blunt edge or rim or terminal region extending transverse to such paper stock flow direction.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 4 shows an exemplary embodiment of a partition foil or sheet or lamella or the like.

DETAILED DESCRIPTION OF THE PREFERRED EMBODIMENTS

Figure 1:
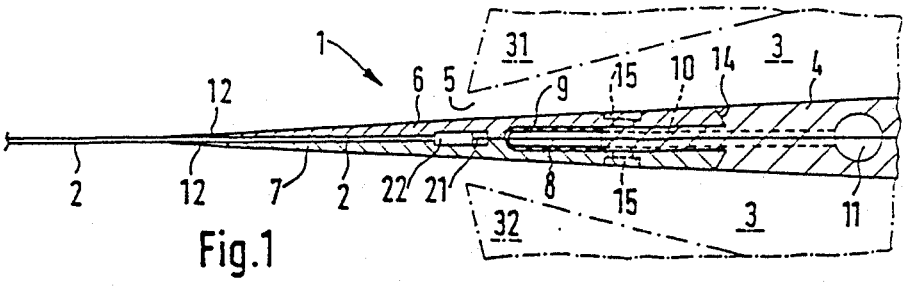
FIG. 1 is a vertical longitudinal sectional view of a first exemplary embodiment of apparatus for retaining or holding a partition foil or sheet and constructed according to the invention and shows the two retaining or holding strips or the like bearing upon one another.

Describing now the drawings, it is to be understood that to simplify the showing thereof, only enough of the construction of the apparatus for retaining a partition foil or sheet or lamella or the like has been illustrated therein as is needed to enable one skilled in the art to readily understand the underlying principles and concepts of this invention. Turning attention now specifically to FIG. 1 of the drawings, the apparatus 1 for retaining or holding a partition foil or sheet 2 or equivalent structure illustrated therein by way of example and not limitation will be seen to be part of a multi-ply headbox of a papermaking machine which, for example, is provided for producing multi-ply tissue paper. The headbox depicted in FIG. 1 is, for example, a two-ply headbox schematically shown in a simplified illustration.

The partition foil or sheet 2 is secured at a partition or divider or separation element 4 or the like which divides in known manner a nozzle chamber 3 of the two-ply headbox and projects toward the exterior through a nozzle outlet or slice or slice opening 5 between an upper lip or lip member 31 and a lower lip or lip member 32. The partition foil or sheet 2 serves to continue keeping apart or separating, in this case, the two paper stock plys, after leaving the divided nozzle chamber 3 over a distance or length as viewed in the direction of travel of the paper stock and formed paper web of the papermaking machine. In the exemplary embodiment shown in FIG. 1, the depicted partition foil or sheet 2 is depicted in fragmentary length or shortened portrayal in the direction of the papermaking machine. The actual length of the partition foil or sheet 2 is adapted to the operational conditions of the papermaking machine or to the qualities or characteristics of the paper stock plys.

The apparatus 1 comprises an upper retaining or holding strip or ledge member 6 and a lower retaining or holding strip or ledge member 7 which are secured at the partition or divider element 4, i.e. at a joining or connecting location 14, without any elevational difference or step between the paper-stock-confronting surfaces of the partition or divider element 4 and the two retaining or holding strips 6 and 7. For this purpose, there is provided a dovetail or tongue-and-groove connection or the like at the joining or connecting location 114. The fastening or fixation of the retaining strips 6 and 7 with the partition element comprises alternately arranged screws or threaded bolts 15 which unite and press together the two retaining or holding strips 6 and 7 and thus exert a pre-load or bias to the latter. Instead of using the screws or threaded bolts 15, rivets or equivalent fastening expedients can be used.

The retaining or holding strips 6 and 7 extend in continuous or through-passing manner across the entire width or cross-machine direction of the partition or divider element 4 and are structured to retain or hold therebetween the partition foil or sheet 2. Furthermore, there are provided grooves or groove means 21 which are formed at confronting surfaces of the retaining or holding strips 6 and 7, such confronting surfaces facing the partition foil or sheet 2. In this manner, a tunnel-shaped space or region is formed in which a fastening or securing edge or rim or portion 22 of the partition foil or sheet 2 can be secured or locked in place.

Figure 2:
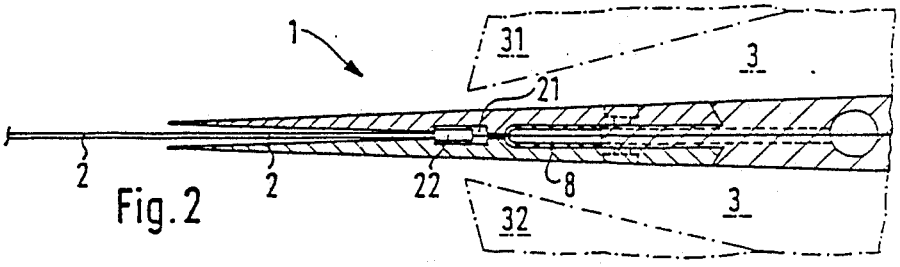
FIG. 2 is the same vertical longitudinal sectional view of the first exemplary embodiment of the apparatus for retaining a partition foil or sheet depicted in FIG. 1, but shows the two retaining or holding strips in their spread apart or expanded position.

Between the confronting surfaces of the retaining or holding strips 6 and 7, which confronting surfaces face the partition foil or sheet 2, there is provided a pressure chamber or space 8 of a pressure device. This pressure chamber 8 can be impinged by a suitable pressurized fluid medium serving to spread apart or expand the two retaining or holding strips 6 and 7 relative to one another. Upon pressurizing the pressure chamber 8, the retaining or holding strips 6 and 7 are spread apart or expanded to such an extent that the partition foil or sheet 2 can be conveniently removed or inserted. This position is depicted in FIG. 2.

The pressure chamber 8 possesses the form or shape of a groove or channel which through-passes between or within the two retaining or holding strips 6 and 7. This groove or channel is lined by means of a sealing coating or lining 9 or the like which can be made of an elastic impervious foil. The space or cavity of the pressure chamber 8 bounded or enclosed by the sealing coating or lining 9 is connected via lines or conduits 10 and 11 to a suitable pressurized fluid medium source which thus has not been particularly shown in the drawings. These lines or conduits 10 and 11 provided for the impinging pressurized fluid medium can be structured as bores or drill holes arranged between the retaining or holding strips 6 and 7 or located in the partition foil or sheet 4. The related or associated fluid medium connection is advantageously located at both sides of the partition foil or sheet 4. It is thus possible, if necessary, to flush or scavenge the pressure system from one side.

As previously mentioned, the retaining or holding strips 6 and 7 or the like are pressed together for preloading or biasing by means of the screws or threaded bolts 15 or equivalent expedients. An elastic deformation of the retaining or holding strips 6 and 7 occurs in the region of these screws or threaded bolts 15 when the retaining or holding strips 6 and 7 are forced apart.

The retaining or holding strips 6 and 7 are structured in mirror-image fashion or relationship with respect to each other. According to one exemplary embodiment illustrated in FIGS. 1 and 2, the retaining or holding strips 6 and 7 terminate or end with an edge or tip or pointed terminal region in the outlet direction of the paper stock, such that no vortexes or whirls can occur in the paper stock flow at the location where the ends of the retaining or holding strips 6 and 7 come to bear at the associated partition foil or sheet 2.

Figure 5:
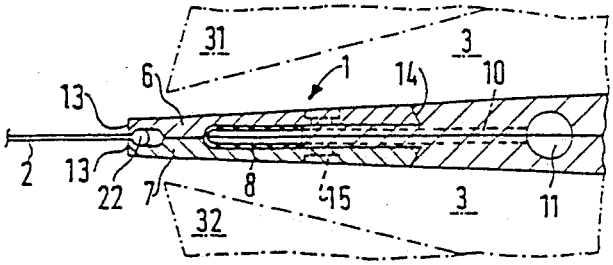
FIG. 5 is a vertical longitudinal sectional view of a second exemplary embodiment of apparatus for retaining a partition foil or sheet or the like and constructed according to the invention.

According to another exemplary embodiment as depicted in FIG. 5, the retaining or holding strips 6 and 7 terminate or end with a blunt edge or rim or terminal region extending transverse to the outlet direction, so that a vortex or whirl-forming step or shoulder is provided at the location where the ends of the retaining or holding strips 6 and 7 come to bear upon the partition foil or sheet 2. This can be desirable in certain operational situations.

Figure 4:
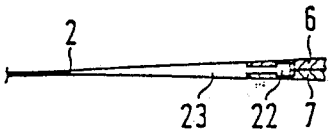
Figure 3:
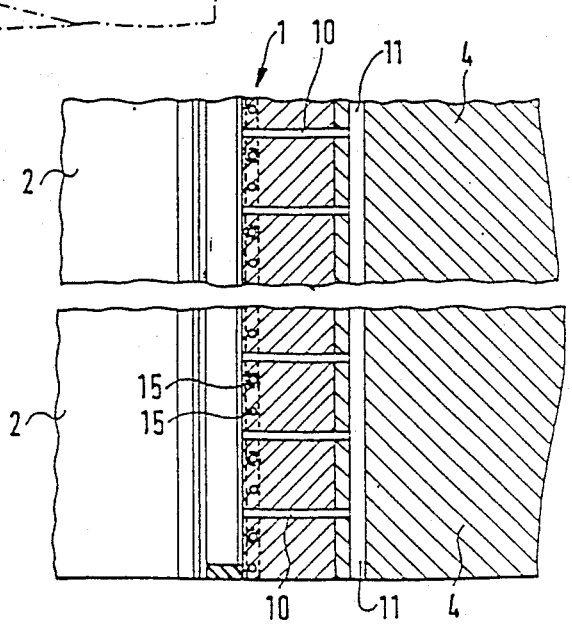
FIG. 3 is a horizontal longitudinal sectional view of the first exemplary embodiment of the apparatus for retaining a partition foil or sheet as depicted in FIG. 1 and shows the apparatus in fragmentary illustration.

However, it is possible to avoid vortex or turbulence at ends or end regions 13 of the retaining or holding strips 6 and 7 by using a partition foil or sheet 2 as depicted in FIG. 4. This foil or sheet 2 is provided, as viewed in the depicted vertical longitudinal section, with a substantially wedge-shaped fitting or adapter piece or element 23 at its end facing the retaining strips 6 and 7. This fitting or adapter piece 23 possesses at its largest or highest location exactly the same height as the ends of the retaining strips 6 and 7 forming the blunt edge or rim 13. By using the partition foil or sheet 2 depicted in FIG. 4, there is no vortex-forming step or shoulder between the fitting or adapter piece or element 23 of the retaining or holding strips 6 and 7.

The present invention also relates to applications in which a multi-ply headbox is structured for producing multi-ply paper web composed of three or more plys, as well as to applications in which the multi-ply headbox is not horizontally arranged, but moreover vertical or downwardly inclined.

While there are shown and described present preferred embodiments of the invention, it is to be distinctly understood that the invention is not limited thereto, but may be otherwise variously embodied and practiced within the scope of the following claims.

Accordingly, what I claim is:

1. In a multi-ply headbox of a papermaking machine, an apparatus for retaining a partition foil at the multi-ply headbox of the papermaking machine and through which travels paper stock in a predetermined direction, comprising:

a partition element;

said partition element dividing a nozzle chamber of the headbox;

a partition foil secured at said partition element;

the partition foil serving to maintain apart plys of paper stock through a predetermined distance as viewed in said predetermined direction of travel of the paper stock;

an upper retaining strip and a lower retaining strip for clamping therebetween a part of the partition foil and each strip being separately secured at said partition element; and pressure means having a pressure chamber provided between said upper retaining strip and said lower retaining strip and connected to a source of pressurized fluid medium and structured and arranged such that upon pressurizing the pressure chamber said upper retaining strip and said lower retaining strip are spread apart relative to one another and leave free between them a region which is required and sufficient for assmebly and disassembly of the partition foil between the upper and lower retaining strips.

2. The apparatus as defined in claim 1, wherein:

said headbox has a predetermined width;

said pressure chamber of said pressure means possessing groove means extending across the entire predetermined width of the headbox;

elastic sealing means for lining said groove means;

said pressure chamber including a space;

said elastic sealing means bounding said space of said pressure chamber;

supply line means for said pressurized fluid medium; and said space of said pressure chamber being capable of being connected via said supply lines to the source of pressurized fluid medium.

3. The apparatus as defined in claim 1, wherein:

the partition foil has a fastening edge; and said upper retaining strip and said lower retaining strip being arranged with respect to one another with a pre-load for clamping said fastening edge of the partition foil.

4. The apparatus as defined in claim 1, wherein:

said plys of paper stock have a predetermined outlet flow direction; and said upper retaining strip and said lower retaining strip being structured in substantially mirror-image relationship with respect to one another and terminating at an edge in said predetermined outlet flow direction.

5. The apparatus as defined in claim 1, wherein:

said plys of paper stock have a predetermined outlet flow direction; and said upper retaining strip and said lower retaining strip being structured in substantially mirror-image relationship with respect to one another and terminating in said predetermined outlet flow direction in a rim extending transverse to said predetermined outlet flow direction.

* * * * *